United States Patent [19]

Gasier et al.

[11] 4,050,286

[45] Sept. 27, 1977

[54] SWAGING APPARATUS

[75] Inventors: James Mills Gasier, Timberlake; William Edgar Currie, Cleveland Heights, both of Ohio

[73] Assignee: Parker-Hannifin Corporation, Cleveland, Ohio

[21] Appl. No.: 732,758

[22] Filed: Oct. 15, 1976

[51] Int. Cl.[2] ..... B21D 41/00

[52] U.S. Cl. ..... 72/416; 29/237; 72/402

[58] Field of Search ..... 72/402, 415, 416, 412; 29/237, 517, 753

[56] References Cited

U.S. PATENT DOCUMENTS

| | | | |
|---|---|---|---|
| 2,291,803 | 8/1942 | Grotnes | 72/402 |
| 3,706,123 | 12/1972 | Whitledge | 72/453.18 |
| 3,740,811 | 6/1973 | Kozusnik | 29/156.4 |
| 3,849,858 | 11/1974 | Whitledge | 29/237 |
| 3,851,514 | 12/1974 | Chen | 29/237 |

*Primary Examiner*—C.W. Lanham
*Assistant Examiner*—Gene P. Crosby
*Attorney, Agent, or Firm*—Donnelly, Maky, Renner & Otto

[57] ABSTRACT

A swaging apparatus in which a pusher member pushes a hose coupling sleeve having a hose end portion therewithin downwardly into a die cavity of a closed die defined by mating segmental die members in a retainer to radially deform said sleeve into gripping engagement with said hose characterized in that upward retraction of the pusher member automatically opens the die by effecting upward and lateral separating movement of said die members thus to release the swaged hose-coupling assembly for downward discharge from between the separated die members and through said retainer. The swaging apparatus is further characterized in that before the pusher member commences its downward swaging stroke on the next unswaged hose-coupling assembly inserted upwardly through the retainer and between the separated die members, the latter are released for movement by gravity into mating engagement within said retainer. The swaging apparatus is yet further characterized in that the opening of the die entails a prying (or a tearing away or tilting) motion of the segmental die members to facilitate stripping of the die members from the swaged hose-coupling assembly.

22 Claims, 6 Drawing Figures

SWAGING APPARATUS

BACKGROUND OF THE INVENTION

In one known form of hose coupling swaging apparatus as disclosed for example in the U.S. Pat. Nos. 3,706,123 and 3,849,858, a pusher and a die actuating mechanism are simultaneously hydraulically actuated downwardly respectively in swaging direction and die closing direction, the apparatus being provided with duplicate cam means to cam segmental die members carried by said mechanism radially into and out of mating engagement as they are moved downwardly and upwardly by the die actuating mechanism. In addition to the complexity of such known apparatus with reference to duplication of cooperating cams for opening and closing the die, such apparatus employs a hydraulic cylinder which is reciprocated with respect to a fixed piston to effect die opening and closing movement as aforesaid and which has a piston reciprocable therein operatively connected with said pusher to actuate said pusher in downward swaging direction and in upward retraction direction. Simultaneous hydraulic actuation of the die closing mechanism and of the pusher may result in damage to the apparatus or to the die members as by the presence of foreign objects between the die members as they approach die closing position, may cause personal injury to the operator as by pinching of fingers between the die members as they approach die closing position, or may damage the hose as by pinching thereof between the die members as they approach die closing position.

In another known form of apparatus for contracting a hose coupling sleeve to grip a hose therewithin as disclosed in U.S. Pat. No. 3,851,514, the hose coupling sleeve is positioned within a collet assembly, and a hydraulically actuated pusher pushes the collet assembly into a tapered die to contract the collet assembly around the hose coupling sleeve thus to crimp it around the hose. Furthermore, in this form of apparatus, if the collet segments stick on the crimped hose coupling it may be necessary to jiggle the hose coupling assembly or to tap the hose coupling assembly with a hammer or the like to strip the crimped hose coupling from the collet segments.

SUMMARY OF THE INVENTION

The swaging apparatus according to the present invention is of simple compact construction and is economical to manufacture in that a hydraulically actuated pusher pushes a hose coupling into a closed die following which the die is opened automatically upon retraction of the pusher to release the swaged hose coupling for insertion of the next unswaged hose coupling.

It is a principal object of this invention to provide a swaging apparatus of the character indicated in which the die is opened by lifting and laterally separating segmental die members thereof responsive to retraction of the pusher following its swaging stroke and in which the die is closed by gravity by releasing the die members from the pusher before the pusher member commences its swaging stroke.

It is another object of this invention to provide a novel die actuating mechanism which strips the die members from the swaged hose coupling by a prying (or tilting or a tearing away) action as an incident of the lifting and lateral separation of the die members during the retraction of the pusher.

Other objects and advantages will appear in the ensuing description.

DETAILED DESCRIPTION OF A PREFERRED EMBODIMENT

Figure 2:
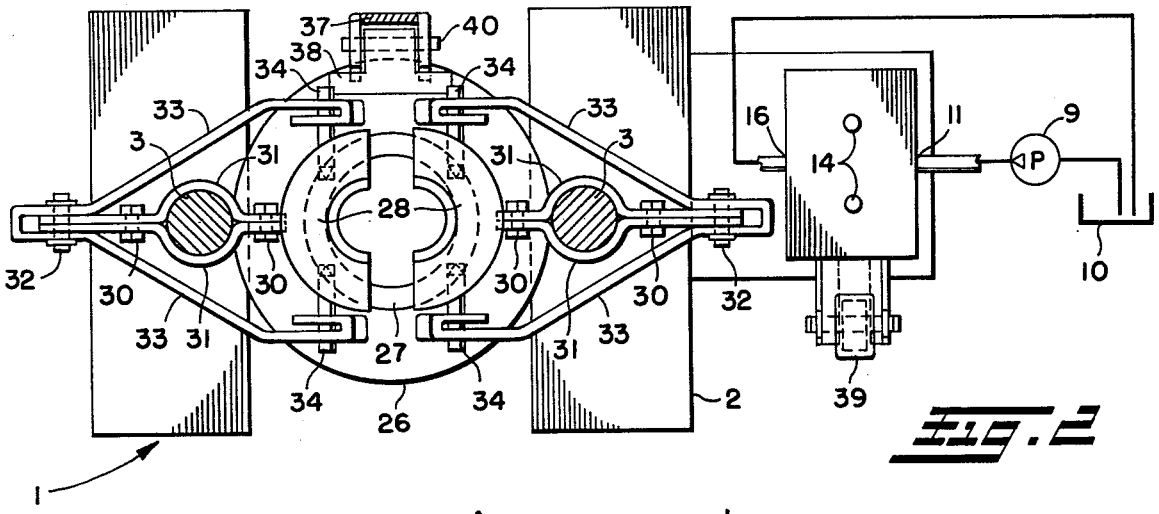
FIG. 2 is a cross-section view taken substantially along the line 2—2, FIG. 1.

The swaging apparatus 1 herein shown comprises a frame structure including a base plate 2 to which upwardly extending parallel posts 3 are welded or otherwise secured with a cross bar 4 secured to the upper ends of said posts 3. A hydraulic cylinder 5 is secured to the middle of the cross bar 4, said cylinder 5 having a piston reciprocable therein with its piston rod 6 connected to a pusher block 7 which is guided by posts 3.

The base plate 2 may have mounted thereon to the rear of the posts 3 a hydraulic power unit which may comprise an electric motor driven pump 9 and a reservoir 10 from which said pump 9 supplies oil under pressure to the inlet port 11 of a cylinder control valve 12 which, for example, may be a spool-type four-way three-position spring centered valve which has motor ports 14;14 connected as by hoses 15;15 to the ports of the cylinder 5, and return port 16 through which oil displaced from either end of the cylinder 5 is returned to the reservoir 10.

The pusher block 7 has a downwardly open recess 17 in which the shank portion of a pusher member 18 is releasably held as by means of the thumb screw 19.

Figure 4:
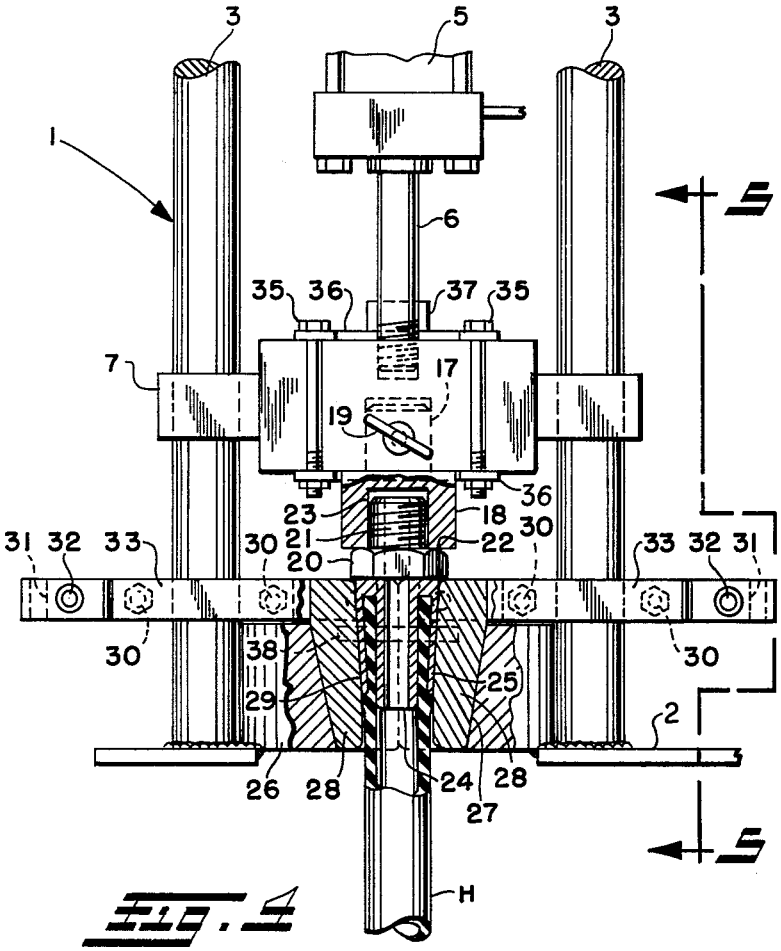
FIG. 4 is a view similar to FIG. 1 except showing the position of the parts of the swaging apparatus as the conclusion of the hose coupling swaging operation.

The lower end of the pusher member 18 is suitably fashioned according to the design of the particular hose coupling which it is desired to swage. The hose coupling 20 herein shown has an externally threaded end portion 21 with an adjacent shoulder 22 constituted by a hex and in this case the pusher member 18 has a recess 23 of diameter slightly larger than the thread size and of depth exceeding the length of the threaded portion 21 whereby swaging force will be applied on the annular shoulder 22 to avoid imposition of force on the threaded end of the hose coupling 20. The hose coupling 20 is of conventional construction including coaxial nipple and sleeve portions 24 and 25 which form an annular chamber for receiving the end portion of a hose H. As shown in FIG. 4, the swaging operation performed by the apparatus 1 herein radially contracts the sleeve portion 25 so that the hose H will be firmly gripped between the nipple portion 24 and the contracted sleeve portion 25.

Welded or otherwise secured to the base plate 2 between the lower end portions of the posts 3 is a die retaining or support ring 26 which has a central tapered bore 27 of non-sticking angle which is coaxial with the cylinder 5 and pusher member 18.

The swaging die herein comprises a pair of segmental die members 28 which, when in mating engagement, have a frusto-conical exterior surface matching the tapered bore 27 and defining therebetween an open-ended die cavity 29 of circular cross-section which may be longitudinally tapered as shown to correspondingly swage the sleeve portion 25 of the hose coupling 20 when the latter is pushed by the pusher member 18 into the closed die.

The lower end of each post 3 above the die retainer 26 has secured thereto as by the screws 30 a bracket 31 which provides a pivot 32 for a die carrier 33 which has pins 34 fitted into chordwise disposed holes in the associated die member 28, said holes being located directly above or near the center of gravity of the die member 28. The pusher block 7 has secured thereto by screw means 35 a bracket assembly 36 which includes a downwardly extending stem member 37 having pivoted thereto a latch member 38 which upon upward retraction movement of the pusher block 7 and pusher member 18 lifts the die carriers 33 and die members 28 upwardly with respect to the die retainer 26 to the position shown in FIG. 1. During such lifting of the die members 28 by engagement with the latch member 38, the pivoting of the carriers 33 about the pivots 32 moves the die members 28 laterally apart thus to release the swaged hose coupling 20 and to enable upward insertion of the next unswaged hose coupling 20 with the threaded end 21 extending into the recess 23 and with the shoulder 22 engaged with the bottom annular surface of the pusher member 18. This die opening operation is stopped by the operator of the apparatus 1 releasing the valve operating handle 39 to permit movement of the valve 12 to neutral position blocking communication of the inlet port 11 and return port 16 with both motor ports 14. If desired, one of the posts 3 may have a limit switch or the like thereon to close a lamp or audible alarm circuit or such limit switch may automatically cause shifting of the valve 12 to neutral position.

Figure 1:
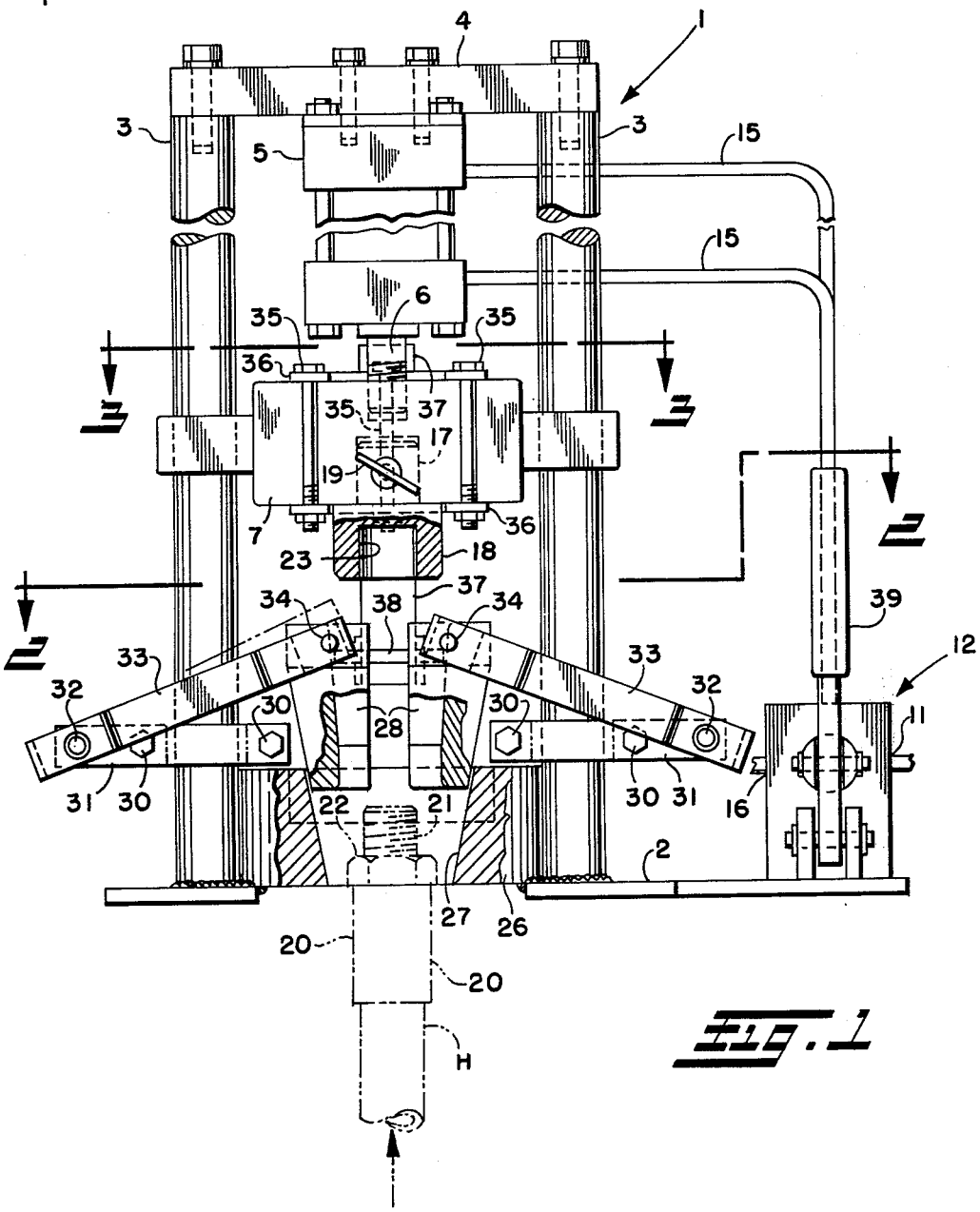
FIG. 1 is a front elevation view partly in cross-section of a swaging apparatus according to the present invention.
Figure 3:
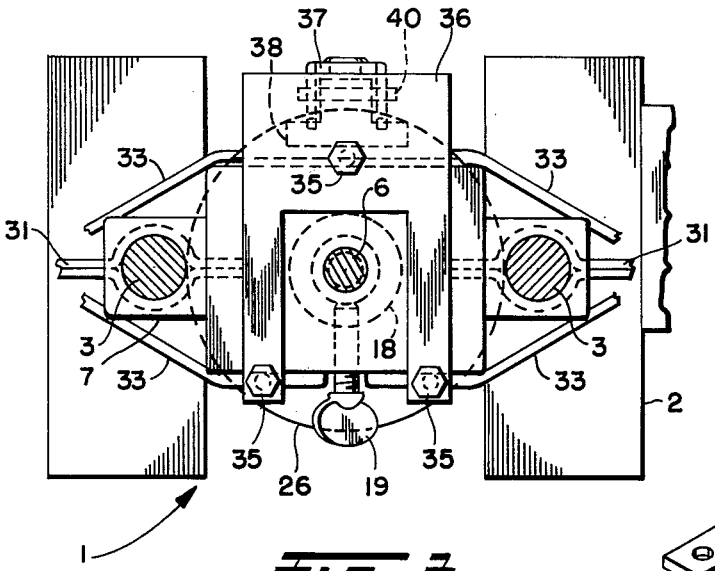
FIG. 3 is a cross-section view taken substantially along the line 3—3, FIG. 1.
Figure 6:
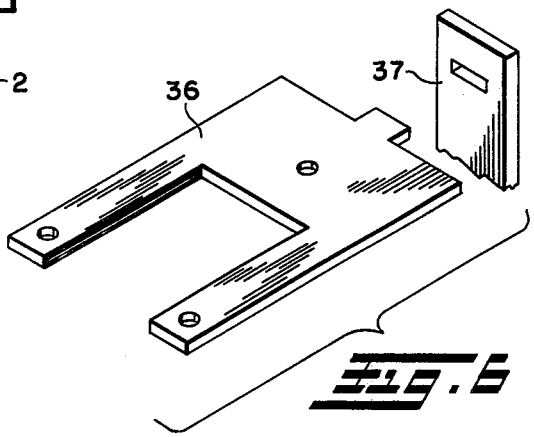
FIG. 6 is a perspective view showing a portion of the bracket by which the die actuating mechanism is secured to the pusher.

As aforesaid, when the apparatus is in the FIG. 1 position, the hose coupling 20 to be swaged may be inserted upwardly through the die retainer 26 and the open die to engage the pusher member 18. When the operator is ready, the valve 12 will be actuated by handle 39 to raise the pusher block 7 and the latch member 38 upwardly until the pins 34 pass over the ends of the latch member 38 whereby the die carriers 33 and die members 28 will drop down by gravity to the die closing position shown in FIG. 4. When the die is closed, the valve handle 39 will be shifted to a position to cause the pusher block 7 and pusher member 18 to move downwardly to push the hose coupling 20 down into the die cavity 29 thereby to cause contraction of the sleeve portion 25 to tightly grip the hose H between the nipple 24 and the sleeve 25.

Figure 5:
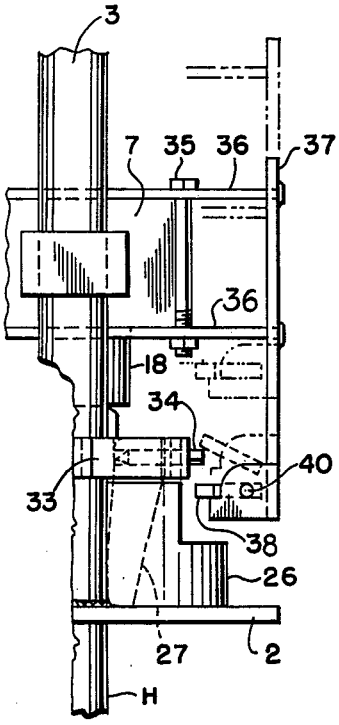
FIG. 5 is a cross-section view taken substantially along the line 5—5, FIG. 4.

Upon completion of the swaging operation, the operator will shift the valve handle 39 to direct fluid under pressure into the lower end of the cylinder 5 to cause upward retraction movement of the pusher block 7 and member 18. During the swaging operation, the latch member 38 engages the pins 34 but because the latch member 38 is pivotally mounted at 40 on the lower end of the stem 37, the latch member 38 will move past the pins 34 (see FIG. 5) and will drop to its normal stop position so as to be disposed under the pins 34. Accordingly, upward movement of the pusher block 7 after completion of the swaging operation will effect engagement of the latch member 38 with the pins 34 to lift the die members 28 out of the retainer 26. By reason of the pivotal mounting 32 of the die carriers 33 and the pivotal mounting 34 of the carriers 33 to the die members 28, the lifting movement of the die members 28 also includes a lateral component which pries the die members 28 with respect to the swaged hose coupling 20 to strip the die members 28 from the swaged hose coupling 20.

By the time that the pusher block 7 and die members 28 reach the FIG. 1 position the swaged hose coupling 20 will be released for downward withdrawal through the die retainer 26 ready for upward insertion of the unswaged hose coupling 20 and for repetition of the foregoing operations.

By reason of the non-sticking taper of the bore 27 of the die retainer 26, the die opening operation involves very little force and, of course, initially the radial or lateral component of movement is of small magnitude whereby large forces are available for stripping the die members 28 from the swaged hose coupling 20 while yet the upward force applied on the pins 34 is of small magnitude.

The die members 28 are readily interchangeable for different sizes of hose couplings 20 simply by yieldably spreading apart of the arms of the carriers 33 for disengagement of the pins 34 from the die member recesses and for snapping into engagement with the replacement die member recesses or by removing the pins 34 from the arms 33.

With the carrier 33 and die member 28 pivots 34 located as previously described, the die members 28 will hang freely as shown in FIG. 1 and even when the die members 28 are further lifted for release by gravity to die closing position, the lower end portions of the die members 28 will yet be within the upper end of the tapered bore 27 of the die retainer 26 to assure that the die members 28 will drop freely by gravity from die opening to die closing position.

To insure consistent swaging results, it is preferred to utilize a hydraulic pressure sufficient to cause the swaged hose coupling 20 to reach a positive stop position relative to the die members 28, i.e. where the hex thereof bottoms against the upper end of the die members 28. To facilitate use of the swaging apparatus 1 herein, the front portion of the base plate 2 will project forwardly from the front edge of a work bench or the like and the posts 3 will be inclined rearwardly so that the axis of the retainer 26, the die cavity 29, the pusher block 7 and pusher member 18, and the cylinder 5 will be correspondingly inclined.

In the operation of the swaging apparatus 1, it is a preferred practice, after the swaging operation has been completed, to grasp the hose H below the die retainer 26 and to exert upward force thereon to hold the coupling shoulder 22 against the pusher 18 as the latter commences its upward retraction stroke. Thus, as the swaged hose coupling 20 is urged upwardly, the die members 28 will be moved upwardly and laterally separated at the pivots 34 to at least partially strip the die members 28 from the swaged sleeve portion 25 by a prying or rocking action even before the latch member 38 engages the pins 34.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. In swaging apparatus of the type wherein a pusher pushes an article to be swaged downwardly into a cavity of a closed die defined by mating segmental die members and wherein die opening means are operative during upward retraction of said pusher to open said die by upward and lateral separating movement of said die members thus to release the swaged article for downward discharge from between said die members; the combination therewith of actuating means on said pusher engageable with said die opening means to open said die in response to upward retraction of said pusher; and means for disengaging said actuating means and die opening means prior to downward movement of said pusher in swaging direction to release said die members for movement into mating engagement.

2. The swaging apparatus of claim 1 wherein said die opening means comprises laterally extending carriers having outer ends pivotally supported by said apparatus and having inner ends from which said die members are pivotally suspended and which are engaged by said actuating means.

3. The swaging apparatus of claim 2 wherein said actuating means comprises a latch member engageable with the inner ends of said carriers.

4. The swaging apparatus of claim 3 wherein said means for disengaging comprises end surfaces of said latch member over which said inner ends pass downwardly in response to additional upward retraction of said pusher.

5. The swaging apparatus of claim 4 wherein said latch member is radially movably supported for positioning under said inner ends during downward movement of said pusher in swaging direction.

6. The swaging apparatus of claim 4 wherein said latch member is pivotally supported to pass over said inner ends to a position underneath said inner ends during downward movement of said pusher in swaging direction.

7. The swaging apparatus of claim 2 wherein the inner end of each carrier has transverse pins pivotally fitting into chordwise recesses in the upper portion of the respective die member; and wherein a transversely projecting portion of at least one pin of each carrier is engaged by said actuating means.

8. The swaging apparatus of claim 7 wherein said actuating means comprises a latch member engaged under said projecting portions; and wherein said means for disengaging comprises end surfaces of said latch member over which said projecting portions pass downwardly in response to additional upward retraction of said pusher.

9. The swaging apparatus of claim 8 wherein said latch member is radially movably supported for positioning under said projecting portions during downward movement of said pusher in swaging direction.

10. The swaging apparatus of claim 8 wherein said latch member is pivotally supported to pass over said projecting portions to a position therebeneath during downward movement of said pusher in swaging direction.

11. In swaging apparatus of the type wherein a pusher pushes an article to be swaged downwardly into a cavity of a closed die defined by a pair of mating segmental die members within a retainer and wherein die opening means are operative during upward retraction of said pusher to open said die by upward and lateral separating movement of said die members with respect to said retainer thus to release the swaged article for downward discharge from between said die members and through said retainer; the combination therewith of actuating means on said pusher engageable with said die opening means to open said die in response to upward retraction of said pusher; and means for disengaging said actuating means and die opening means prior to downward movement of said pusher in swaging direction to release said die members for movement into mating engagement within said retainer.

12. The swaging apparatus of claim 11 wherein said die opening means comprises opposite laterally extending carriers having outer ends pivotally supported by said apparatus and having inner ends which straddle the upper portions of the respective die members and by which the latter are pivotally suspended about axes parallel to those of the respective outer ends; and wherein said actuating means engages underneath said inner ends at least on one side of said die members.

13. The swaging apparatus of claim 12 wherein said means for disengaging comprises end surfaces on said actuating means over which said one side of said inner ends pass downwardly in response to additional upward retraction of said pusher.

14. The swaging apparatus of claim 13 wherein said actuating means comprises a pivotally mounted latch member which passes over said one side of said inner ends to a position therebeneath during downward movement of said pusher in swaging direction.

15. In swaging apparatus of the type wherein a pusher pushes a hose coupling sleeve downwardly into the open-ended cavity of a closed die defined by a pair of mating segmental die members within a retainer having a tapered bore embracing said mating die members thus to contract said sleeve around a hose therewithin and wherein die opening means are operative during upward retraction of said pusher to open said die by upward and lateral separating movement of said die members with respect to said retainer thus to release the swaged hose coupling for downward discharge from between said die members and through the bore of said retainer for upward insertion of an unswaged hose coupling; the combination of actuating means on said pusher engageable with said die opening means to open said die in response to upward retraction of said pusher; and means for disengaging said actuating means and die opening means prior to downward movement of said pusher in swaging direction to release said die members for movement into mating engagement within the tapered bore of said retainer.

16. The swaging apparatus of claim 15 wherein said die opening means comprises opposite laterally extending carriers having outer ends pivotally supported by said apparatus and having inner ends which straddle the upper portions of the respective die members and by which the latter are pivotally suspended about axes parallel to those of the respective outer ends; and wherein said actuating means engages underneath said inner ends at least on one side of said die members.

17. The swaging apparatus of claim 16 wherein said means for disengaging comprises end surfaces on said actuating means over which said one side of said inner ends pass downwardly in response to additional upward retraction of said pusher.

18. The swaging apparatus of claim 17 wherein said actuating means comprises a pivotally mounted latch member which passes over said one side of said inner ends to a position therebeneath during downward movement of said pusher in swaging direction.

19. In swaging apparatus of the type wherein a hydraulically actuated pusher pushes an article to be swaged downwardly into an open-ended cavity of a closed die defined by a pair of mating segmental die members within a retainer and wherein die opening means are operative during upward retraction of said pusher to open said die by upward and lateral separating movement of said die members with respect to said retainer thus to release the swaged article for downward discharge from between said die members and through said retainer; the combination therewith of actuating means on said pusher engageable with said die opening means to open said die in response to upward retraction of said pusher; and means for disengaging said actuating means and die opening means prior to downward movement of said pusher in swaging direction to release said die members for movement into mating engagement within said retainer; said pusher being actuated by a hydraulic cylinder which is fixed to said apparatus and which has its piston rod secured to said pusher in coaxial relation to said cavity; said hydraulic cylinder having a directional control valve operatively associated therewith to effect downward movement of said pusher in swaging direction and interrupted upward retraction of said pusher respectively to open and close said die as aforesaid.

20. In swaging apparatus of the type wherein a pusher pushes an article to be swaged axially into one end of an open-ended cavity of a closed die defined by a pair of mating segmental die members and wherein die opening means are operative during axial retraction of said pusher to open said die by corresponding axial and radial separating movement of said die members thus to release the swaged article for axial discharge in swaging direction from between said die members; the combination therewith of actuating means on said pusher engageable with said die opening means to open said die in response to retraction of said pusher; and means for disengaging said actuating means and die opening means prior to axial movement of said pusher in swaging direction to release said die members for free movement into mating engagement.

21. In swaging apparatus of the type wherein a pusher pushes a hose coupling sleeve downwardly into the open-ended cavity of a closed die defined by a pair of mating segmental die members within a retainer having a tapered bore embracing said mating die members thus to contract said sleeve around a hose therewithin and wherein die opening means are operative to open said die by upward and lateral separating movement of said die members with respect to said retainer thus to release the swaged hose coupling for downward discharge from between said die members and through the bore of said retainer for upward insertion of an unswaged hose coupling; the combination therewith of actuating means engageable with said die opening means to open said die in response to at least partial upward retraction of said pusher; said actuating means being operative prior to downward movement of said pusher in swaging direction to release said die members for movement into mating engagement with the tapered bore of said retainer.

22. The swaging apparatus of claim 21 wherein said die opening means comprises opposite laterally extending pivoted carriers having inner ends which straddle the upper portions of the respective die members and by which the latter are pivotally suspended about axes parallel to those of the respective carriers; and wherein said actuating means engages said carriers to cause upward swinging movement of said inner ends thus to open said die by consequent upward and lateral separating movement of said die members.

* * * * *